United States Patent [19]

Scherer et al.

[11] Patent Number: 4,950,503

[45] Date of Patent: Aug. 21, 1990

[54] PROCESS FOR THE COATING OF A MOLYBDENUM BASE

[75] Inventors: Jeremy D. Scherer, Dartmouth; Paul E. Kutniewski, Fairhaven, both of Mass.

[73] Assignee: Olin Corporation, New Haven, Conn.

[21] Appl. No.: 299,372

[22] Filed: Jan. 23, 1989

[51] Int. Cl.[5] ..... B05D 3/02; B05D 3/04; B05D 5/00; B05D 1/32

[52] U.S. Cl. ..... 427/229; 427/123; 427/282; 427/287; 427/374.6; 427/376.8

[58] Field of Search ..... 427/282, 376.4, 377, 427/287, 376.8, 229, 123, 126.6, 126.3, 226, 374.6

[56] References Cited

U.S. PATENT DOCUMENTS

| | | | |
|---|---|---|---|
| 2,463,342 | 3/1949 | Wiczer | 29/527.2 |
| 3,261,673 | 7/1966 | Wheildon, Jr. | 428/552 |
| 4,266,089 | 5/1981 | Scherer | 357/74 X |
| 4,266,090 | 5/1981 | Scherer | 357/74 X |
| 4,506,108 | 3/1985 | Kersch et al. | 357/75 X |
| 4,639,399 | 1/1987 | Aprigliano | 428/623 |
| 4,649,229 | 3/1987 | Scherer et al. | 357/74 X |
| 4,745,033 | 5/1988 | Timmons | 428/552 |

FOREIGN PATENT DOCUMENTS

| | | | |
|---|---|---|---|
| 2,142,559 | 2/1973 | France | 427/377 |
| 732,406 | 5/1980 | U.S.S.R. | 427/229 |

*Primary Examiner*—Evan Lawrence

*Attorney, Agent, or Firm*—Gregory S. Rosenblatt; Paul Weinstein

[57] ABSTRACT

A process for coating a molybdenum base with an oxidation resistant layer. The oxidation resistant layer is applied as an oxide powder which is converted to the base metal or metal alloy by heating in a reducing atmosphere. The coating layer is characterized by good adhesion to the base and is readily wet by a solder or brazing material.

10 Claims, 1 Drawing Sheet

PROCESS FOR THE COATING OF A MOLYBDENUM BASE

Figure 1:
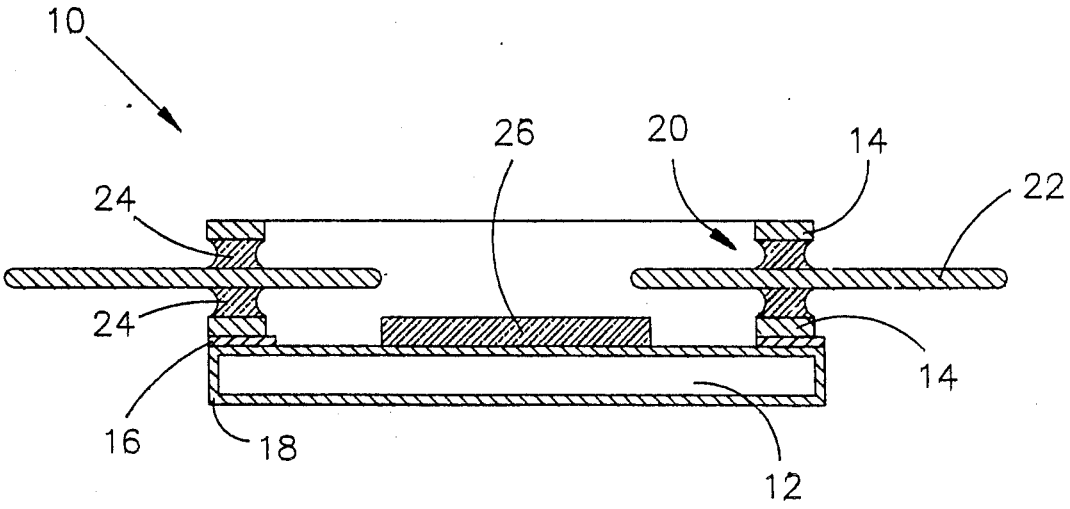

This invention relates to metal packages adapted to house integrated circuits. More particularly, the invention relates to metal flat packages for housing hybrid microelectronic devices.

Metal flat packages are normally comprised of three major components. First is a frame. The frame is generally a continuous metal ring which extends around the periphery of the package and forms the side walls of the package. The second component is the leads which permit electrical power and signals to pass to and from the microelectronic device. The leads are passed through openings in the sides of the frame. The leads are electrically isolated from the side walls by means of glass or ceramic seals.

The final component is the base. The base is bonded to one surface of the frame. A microelectronic device is then attached to the base and electrically connected to the leads. Assembly is completed by sealing a lid to the second surface of the frame typically by welding or soldering thereby enclosing the electronic device.

Meal flat packages are often employed to house power hybrid devices. These packages generate significant quantities of heat during operation, on the order of from about 2 to 3 watts up to about 100 watts. Consequently, one primary function of the base component is to dissipate heat away from the electronic device.

To this end, various metals and metal alloys have been utilized as base components in metal flat packages Typically, the base material is selected to be KOVAR, a trademark for an alloy containing iron, nickel and cobalt. Kovar has a coefficient of thermal expansion of about $56\times10^{-\partial}$in/in/°C. The coefficient of thermal expansion of KOVAR is close to that of alumina, the material normally used in the manufacture of hybrid mircoelectronic circuits. Due to the similarity in coefficient of thermal expansion of the base component and these microelectronic devices, significant mechanical stresses are not introduced during the bonding of the microelectronic devices or during operation. A disadvantage with the use of KOVAR is poor thermal conductivity. The thermal conductivity of KOVAR is about 0.04 cal/cm$^2$/cm/sec/°C. A device such as a power hybrid generates more heat than the KOVAR base is capable of dissipating. As a result, the device heats up, decreasing its operating life.

To increase the thermal dissipation of a flat package, other materials have been used as the base component For example, U.S. Pat. Nos. 4,266,089 and 4,506,108 disclose copper bases brazed or welded to KOVAR or stainless steel frames. The copper base is characterized by exceptional thermal conductivity, on the order of 25 times that of KOVAR. However, the coefficient of thermal expansion of copper, which is about $180\times10^{-7}$ in/in/°C., is significantly higher than that of the microelectronic devices. To prevent fracture of the device due to thermal mismatch a buffer layer is frequently employed. In U.S. Pat. No. 4,266,089 a beryllia base buffer is disclosed. In U.S. Pat. No. 4,506,108 a beryllia or alumina ceramic base of controlled dimensions is disclosed. While reducing thermally induced stresses, the bases also reduce thermal dissipation. The use of a buffer mandates additional processing steps to assemble the microelectronic package.

Yet another material useful for the package base component is molybdenum. Molybdenum bases for flat packages have been disclosed in U.S. Pat. Nos. 4,266,090 and 4,649,229, both by one of the applicants to the present invention. The thermal conductivity of molybdenum is about 0.34 cal/cm$^2$/cm/sec/°C. or approximately 8 times that of KOVAR. The coefficient of thermal expansion of molybdenum is sufficiently close to that of the microelectronic devices to permit the direct bonding of the microelectronic devices to the base without the addition of a buffer.

Molybdenum is a reactive metal and readily oxidizes. Molybdenum oxide is not wet by most conventional solders and brazes. It is difficult to bond the molybdenum base to the package frame. To facilitate bonding, it is known to coat the molybdenum base with an oxidation resistant layer. For example, U.S. Pat. No. 4,266,090 discloses plating the molybdenum with nickel, gold or other alloys and then subsequently sintering at a temperature of from about 350° C. to about 400° C.

U.S. Pat. No. 4,649,229 discloses a plating process that does not require a subsequent sintering step. In this patent, successive layers of copper, nickel and gold are plated on the molybdenum substrate prior to bonding to the frame.

While a plated oxidation resistant layer is readily wet by the solder or braze and provides for an acceptable bond to the frame, obtaining an adherent layer by plating is not an easy task. As noted earlier, molybdenum is a reactive metal and oxidizes very readily. The oxide is difficult to remove chemically. A good way to remove this surface oxide is to fire the molybdenum base is a reducing atmosphere, such as hydrogen. The base is then cooled and packaged in a neutral atmosphere such as nitrogen. The bases are then transferred in the neutral atmosphere to a plating shop for deposition of the oxidation resistant coating Even with the above precautions, the adhesion of the plated layer deteriorates if the molybdenum is not plated within about 48 hours of the hydrogen reduction process.

Many other processes to coat molybdenum are also known, for example, the text "High-Temperature Oxidation-Resistant Coatings" prepared by the Committee on Coatings, National Materials Advisory Board, Division of Engineering, National Research Council discusses coating Molybdenum at pages 99–107. The application of metal and metal alloy oxidation resistant layers is disclosed using electrodeposition, flame-spraying, cladding and molten bath immersion.

The use of ceramic coatings such as $Al_2O_3$ and $ZrO_2$ has been disclosed. The ceramic coatings are useful for high temperature short term applications, such as in rocket engines at temperatures in the range of about 3500° F. to 4000° F. The ceramic coatings are brittle and prone to cracking or spalling.

Other oxide coatings to protect a metallic substrate are disclosed in U.S. Pat. Nos. 3,261,673, 4,639,399 and 4,745,033. U.S. Pat. No. 3,261,637 discloses achieving better adhesion of a ceramic coating to a stainless steel substrate by applying an intermediate metallic layer by a process such as flame spraying or electrodeposition. For example, a stainless steel base is coated with flame sprayed nickel followed by zirconia.

U.S. Pat. No. 4,745,033 discloses coating a molybdenum base with a plasma-sprayed molybdenum-refractory oxide coating comprising a plurality of layers in which the concentration of refractory oxide increases as the distance from the base increases.

U.S. Pat. No. 4,639,399 discloses a nickel oxide coating for gas turbine blades comprising a metallic substrate, an aluminide coating, a ceramic coating and an exterior nickel oxide coating.

Oxide coatings are not suitable for coating the molybdenum base component in a flat package because the solder or braze material used to join the base to the frame will not wet the oxide coating. Additionally, the coefficient of thermal expansion of the oxide coating is generally less than that of the molybdenum substrate and the coating will crack during heat to brazing temperatures.

Finally, U.S. Pat. No. 2,463,342 discloses coating a base with a metallic oxide and a reducing agent. When the base is heated a thermite reaction is initiated. The metallic coating is reduced to the metal in the liquid state which is then capable of coating the base. For example, a mixture of aluminum and nickel oxide may be used to coat the base with nickel through the reaction:

$$2Al+Ni_2O_3 \rightarrow Al_2O_3+2Ni$$

The difficulty with such a reaction is the precursor powders must be applied in the proper stoichiometric ratio. Additionally, the resultant alumina must be removed.

From the above discussion, it is apparent that the conventional methods of coating a molybdenum base are not ideal for the manufacture of flat packages. Electrodeposition requires an oxide free molybdenum surface which is difficult to obtain and once formed, readily reoxidizes. Ceramic and other oxide coatings are not suitable as the soldering or brazing agents used to join the base component to the frame will not wet the coating. These coatings are further quite brittle and have coefficients of thermal expansion which are lower than that of the molybdenum base leading to possible fracture during brazing. Chemical conversion reactions, require careful balancing of stoichiometry and a subsequent cleaning operation to remove the resultant oxide.

Accordingly, it is an object of the present invention to provide a process for coating a molybdenum base with an oxidation resistant coating which overcomes the difficulties encountered by the prior art.

It is an advantage of the present invention that the coating is readily wet by a brazing material.

It is a further advantage of the invention that the molybdenum oxide is reduced during the coating deposition process so that no pre-cleaning or special handling of the base is required.

It is yet another advantage of the present invention that the coating is ductile and has a coefficient of thermal expansion close to that of the base so that the integrity of the coating is not decreased by subsequent brazing operations.

It is still another advantage of the invention that the coating may be applied to select portions of the base.

These objects and advantages are achieved by coating the molybdenum substrate with a powder comprised of the oxide of the desired oxidation resistant material. The substrate and powdered oxide are heated in a reducing atmosphere to a temperature sufficient to reduce the oxide to the metallic form of the oxidation resistant material. The substrate and second material are further heated in a reducing or oxidizing atmosphere to a temperature sufficient to sinter the oxidation resistant coating to the molybdenum base. The coated base is then cooled in a neutral or reducing atmosphere The resultant coating is a metal or metal alloy bonded to the base. The coating is ductile and is readily wet by brazing and soldering materials The coating is amenable to receiving a second coating layer such as by electroplating.

A better understanding of the essential features of the invention will be obtained from the following specification and figures FIG. 1 shows in cross-section a flat package containing a base coated in accordance with the process of the invention.

Figure 2:
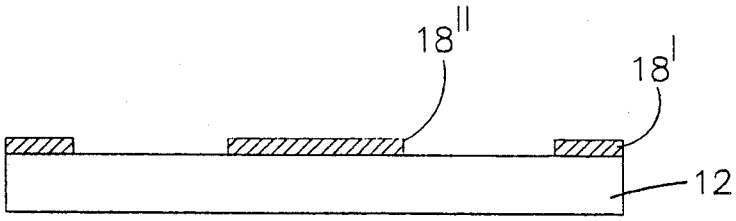

FIG. 2 shows in cross-section a selectively coated base component in accordance with the invention.

The FIG. 1 shows a flat package 10 containing a molybdenum base 12 coated in accordance with the present invention. The base 12 is bonded to a frame 14 by a solder or braze 16. To facilitate brazing, the base 12 is coated with an oxidation resistant material 18. The frame 14 contains apertures 20 through which the leads 22 are inserted. The apertures are sealed with an electrically insulating glass or ceramic 24 which serves to hold the leads in position as well as electrically isolate the leads 22 from the package 10. A microelectronic device 26, for example a silicon based semiconductor power hybrid is bonded to the base 12. The device is electrically connected to the leads 22 by a known process such as wire bonding. Finally, a cover component (not shown) is bonded to the frame to enclose the electronic device.

The oxidation resistant layer 18 may be any metal which is readily solderable A preferred metal is nickel which is supplied in the form of nickelous oxide In accordance with the invention, the layer is applied by the following process.

A powdered oxide such as NiO, is combined with a vehicle such as terpinol and applied to the surface of the molybdenum base by a process such as silk screening or spraying. The thickness of the applied oxide layer is from about 0.0002 inches to about 0.0008 inches and most preferably about 0.0005 inches.

The application techniques, are readily adaptable to include masking so that the nickel oxide is applied only to selective regions of the base. For example, as shown in FIG. 2, the nickel layer may be formed as a seal ring 18' around the perimeter of the base 12. A metallized pad 18'' may be deposited in an interior region of the base 12 to facilitate bonding of a microelectronic device. Other regions of the base which are not intended to be soldered, brazed or electroplated may remain uncoated.

The coated base is then placed in a controlled atmosphere furnace. A reducing atmosphere, such as hydrogen or forming gas is supplied. The coated base is then gradually heated. The reducing atmosphere penetrates the coating layer, so that when the coated base reaches a temperature of from about 800° C. to about 900° C. the molybdenum oxide on the surface of the substrate is substantially reduced to an essentially pure molybdenum surface. The temperature at which significant reduction of the molybdenum oxide is dependent upon the degree of oxidation on the base and slightly higher temperatures may sometimes be required. Since the atmosphere of the furnace is controlled and oxygen free, the reformation of molybdenum oxides is not a problem.

The furnace continues to heat up to a higher temperature at which point the applied oxide layer is reduced to the desired metallic coating. The reduction temperature is generally below the melting temperature of the coating material and adhesion is through sintering rather than surface wetting For a nickel oxide coating layer, the conversion to nickel occurs at a temperature of from about 925° C. to about 975° C. As the atmosphere is maintained as a reducing environment, a clean nickel surface is in contact with a clean molybdenum surface. These two surfaces readily bond through sintering forming an adherent nickel coating on the surface of the molybdenum Once the oxidation resistant layer has been bonded to the molybdenum base the part is cooled to room temperature. Since the oxidation resistant layer is susceptible to oxidation at elevated temperatures, for example, nickel will oxidize at temperatures above about 200° C., the furnace atmosphere is either maintained as reducing or converted to a neutral atmosphere such as nitrogen or argon. Once cooled below the oxidation threshold temperature, the coated base may be removed from the protective atmosphere and prepared for further processing.

While the description above details coating with a metal, the invention is readily applicable to the deposition of alloy coatings The desired oxides are combined in a desired concentration and well mixed. The oxide mixture is then combined with a vehicle and applied to the base as above.

Referring back to the FIG. 1, the coated base 12 may be bonded directly to the frame 14 by brazing or soldering. For example, if the coating 18 is nickel and the frame 14 is Kovar, a suitable braze 16 is the copper silver eutectic which has a composition of 28% by weight copper and 72% silver. The braze is applied as a paste or metallic preform and heated to a temperature sufficient to melt the braze. For copper silver eutectic, this temperature is about 800° C. A neutral or reducing atmosphere may be used. A mild flux is also an option depending on the requirements of the braze.

Alternatively, it is frequently desirable to use a lower melting temperature solder as extended exposure to high temperatures may lead to embrittlement of the molybdenum The oxidation resistant coating 18 is readily coated with a more solderable material such as gold by any process known in the art, such as electroplating. If the molybdenum substrate is nickel coated and then gold plated by any process known in the art and the KOVAR frame is likewise gold plated, a gold tin eutectic solder having a composition of 80% by weight gold and 20% by weight tin may be utilized This solder melts at a temperature of about 280° C. The gold tin solder readily wets the plated frame and base at temperatures as low as about 320° C. in a neutral atmosphere.

The flat package is then assembled according to conventional manufacturing procedures. The leads are glass sealed to the Kovar frame by any conventional glass to metal sealing technique For example, the apertures may be pre-oxidized in a wet reducing atmosphere, the leads and glass powder positioned in the apertures and the glass then fired at a temperature of from about 950° C. to about 1050° c. in a controlled, protective atmosphere for a time sufficient to achieve a uniform hermetic glass to metal seal. As the glass firing temperature is usually quite high, it is often preferable to glass seal the leads prior to bonding the base to the frame.

Once the leads and base are in place, the microelectronic device is bonded to the base. Since the coefficient of thermal expansion of the molybdenum base is sufficiently close to that of the semiconductor device, hard solders such a gold silicon or gold germanium may be used. Soft solders such as tin lead alloys are also acceptable.

The leads are then electrically connected to the electronic device by a known technique such as wire bonding Then, to complete the package, a lid is bonded to the side of the frame opposite the base component, enclosing the microelectronic device.

While the process is described in terms of coating a molybdenum base for use as a flat package base, it should be readily apparent, the process is suitable for any application in which it is desired to coat a molybdenum structure with an oxidation resistant coating The patents and publication set forth in the specification are incorporated by reference herein.

It is apparent that there has been provided in accordance with this invention a process to coat a molybdenum base with an oxidation resistant metal or metal alloy which fully satisfies the objects, features and advantages set forth hereinabove. While the invention has been described in combination with specific embodiments thereof, it is evident that many alternatives, modification and variations will be apparent to those skilled in the art in light of the foregoing description. Accordingly, it is intended to embrace all such alternatives, modifications and variations as fall within the spirit and broad scope of the appended claims.

We claim:

1. A process for coating a molybdenum base with an oxidation resistant layer of a sinterable second metallic material, comprising the steps of:

coating at least a portion of said base with the powdered oxide of said second material;

heating said base and said powdered oxide in a reducing atmosphere to a temperature sufficient to reduce any molybdenum oxide originally present on said base to molybdenum;

further heating said base and said powdered oxide to a temperature sufficient to reduce said powdered oxide to said second material;

sintering said second material to said base; and cooling said base and said second material in a neutral or reducing atmosphere.

2. The process of claim 1 wherein said powdered oxide is selected to be nickel oxide.

3. The process of claim 2 wherein the step of coating said molybdenum base with said powdered nickel oxide comprises:

mixing said powdered nickel oxide with a vehicle; and screening a layer of said mixture onto said base in a desired pattern and to a desired thickness.

4. The process of claim 3 including applying said nickel oxide layer to a thickness from about 0.0002 inches to about 0.0008 inches.

5. The process of claim 4 including applying said nickel oxide layer over selective regions of said base.

6. The process of claim 4 including applying said nickel oxide layer over the entire surface of said base.

7. The process of claim 4 wherein said base and said powdered nickel oxide are heated in an atmosphere consisting essentially of hydrogen.

8. The process of claim 7 including heating said base and powdered nickel oxide in hydrogen up to a temperature of from 800° C. to about 900° C. to reduce any molybdenum oxide.

9. The process of claim 8 wherein said base and powdered nickel oxide are further heated in hydrogen to a temperature of from about 925° C. to about 975° C. to reduce said powdered nickel oxide to nickel and to sinter said nickel to said base.

10. The process of claim 9 wherein said base and nickel are cooled in a neutral atmosphere.

* * * * *